US007558503B2

(12) United States Patent
Kitazawa et al.

(10) Patent No.: US 7,558,503 B2
(45) Date of Patent: Jul. 7, 2009

(54) IMAGE FORMING APPARATUS WITH A PROXIMITY CHARGER ROLLER

(75) Inventors: Atsunori Kitazawa, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 265 days.

(21) Appl. No.: 11/260,673

(22) Filed: Oct. 26, 2005

(65) Prior Publication Data

US 2006/0099005 A1 May 11, 2006

(30) Foreign Application Priority Data

Nov. 10, 2004 (JP) ..... 2004-325960

(51) Int. Cl.
*G03G 15/02* (2006.01)

(52) U.S. Cl. ..... 399/100; 399/176

(58) Field of Classification Search ..... 399/100, 399/176, 115

See application file for complete search history.

(56) References Cited

U.S. PATENT DOCUMENTS 6,751,427 B2 * 6/2004 Sugiura ..... 399/100
6,961,529 B2 * 11/2005 Kosuge ..... 399/176
7,139,512 B2 * 11/2006 Namiki et al. ..... 399/176
7,155,146 B2 * 12/2006 Kosuge et al. ..... 399/168
2001/0053298 A1 * 12/2001 Fujishiro et al. ..... 399/159
2002/0172525 A1 * 11/2002 Sugiura ..... 399/100
2003/0180071 A1 * 9/2003 Suda ..... 399/159
2004/0253020 A1 * 12/2004 Noh ..... 399/167
2006/0078353 A1 * 4/2006 Kosuge et al. ..... 399/176

FOREIGN PATENT DOCUMENTS

JP 07140763 A * 6/1995
JP 2001-350321 12/2001

* cited by examiner

*Primary Examiner*—David M Gray
*Assistant Examiner*—Andrew V Do
(74) *Attorney, Agent, or Firm*—Hogan & Hartson LLP

(57) ABSTRACT

A proximity charger roller is disposed in proximity to a surface of an image carrier and uniformly charges an effective charging area of the image carrier. Abutting portions abut on the image carrier at its both edges which are located on the outer side of the effective charging area, thereby maintaining the proximity distance between the circumferential surface of the proximity charger roller and the image carrier constant. A cleaning roller is longer than the spacing between the abutting portions which are at the both edges, abuts on the abutting portions which are at the both edges, and presses with predetermined pressing force in the direction of the image carrier. The surface of the cleaning roller is made of a soft material and cleans a surface area between the two abutting portions of the proximity charger roller.

5 Claims, 7 Drawing Sheets

IMAGE FORMING APPARATUS WITH A PROXIMITY CHARGER ROLLER

CROSS REFERENCE TO RELATED APPLICATION

The disclosure of Japanese Patent Applications No. 2004-325960 filed Nov. 10, 2004 including specification, drawings and claims is incorporated herein by reference in its entirety.

BACKGROUND OF THE INVENTION

1. Field of the Invention

The present invention relates to an image forming apparatus which comprises an image carrier, a charger apparatus which charges an effective charging area of the image carrier using a proximity charger roller which is conductive and is disposed in proximity to a surface of the image carrier, an exposure apparatus which forms a latent image in the effective charging area, and a developer apparatus which develops the latent image with a developer.

2. Description of the Related Art

In general, in an image forming apparatus, after a charging apparatus uniformly charges an effective charging area of a surface of a photosensitive member which is an image carrier, an exposure apparatus exposes and accordingly writes an electrostatic latent image on thus uniformly charged surface of the image carrier, and a developer apparatus develops the electrostatic latent image and forms a developer image on the surface of the image carrier. Following this, a transfer apparatus transfers the developer image thus formed on the surface of the image carrier onto a transfer member such as a paper, whereby an image is formed.

A charging apparatus which uniformly charges a surface of an image carrier may be a charger roller, a charger brush, a corotron or the like which may be of the contact type which comes into contact with the surface of the image carrier or the non-contact type which does not contact the surface of the image carrier. As a charging apparatus of the non-contact type which uses a charger roller, such an apparatus has been proposed in which a film material is wound around as gap members at the both edge portions of a charger roller which is obtained by disposing an elastic member around the outer circumference of a metal core and a gap corresponding to the thickness of the film material is ensured between the image carrier and the charger roller (See Japanese Unexamined Patent Application Publication No. 2001-350321, for instance).

SUMMARY OF THE INVENTION

However, the conventional charger apparatus described in Japanese Unexamined Patent Application Publication No. 2001-350321, due to its structure that a load is applied and pressing is provided on the outer side relative to the gap members which are at the both edges of the charger roller and which abut on the image carrier, has a problem that the gap members serve as fulcrums and the charger roller bends along the axial direction. It is necessary to maintain a proximity distance (gap) between the charger roller and the image carrier constant along the axial direction in order for the charger roller to uniformly charge the image carrier. Therefore, bending of the charger roller along the axial direction makes it impossible to maintain the proximity distance constant near the edge portions and at a central portion of the charger roller and makes it difficult to achieve a favorable charging characteristic.

Further, in the conventional charger apparatus described in Japanese Unexamined Patent Application Publication No. 2001-350321, since the charger roller and the image carrier do not contact, the absence of such contact will never allow a developer remaining on the image carrier to adhere directly to the charger roller. The remaining developer however could get scattered and adhere to the charger roller. Another possibility is adhesion to the charger roller of the developer scattered from the developer apparatus, dust floating in the air and the like. On these occasions as well, such matters adhering to the charger roller varies the proximity distance between the charger roller and the image carrier and it is therefore not possible to obtain a favorable charging characteristic.

The present invention has been made in light of these problems and it is an object of the present invention to provide an image forming apparatus with a favorable charging characteristic.

According to an aspect of the present invention, there is provided an image forming apparatus, comprising: an image carrier; a charger apparatus which charges an effective charging area of said image carrier using a proximity charger roller which is conductive and is disposed in proximity to a surface of said image carrier; an exposure apparatus which forms a latent image in said effective charging area; and a developer apparatus which develops said latent image with a developer, wherein said charger apparatus comprises: a pair of abutting portions which abut on said image carrier at both edges which are located on outer side of said effective charging area, thereby maintaining a proximity distance from said proximity charger roller to said image carrier constant; and a cleaner which has an elongated shape longer than a spacing between said pair of abutting portions, has a pair of edge portions and a central portion in between, and is pressed against said proximity charger roller on an opposite side of said image carrier relative to said proximity charger roller in a condition that both of said pair of edge portions are located respectively facing said pair of abutting portions, thereby making said proximity charger roller abut on said image carrier with said pair of abutting portions between and cleaning a surface area of said proximity charger roller which is between said pair of abutting portions with said central portion.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Figure 1:
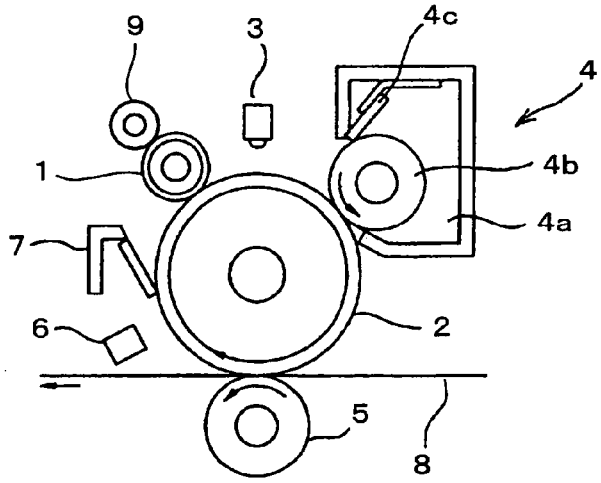
FIG. 1 is a side view which shows an embodiment of an image forming apparatus according to the present invention.
Figure 2:
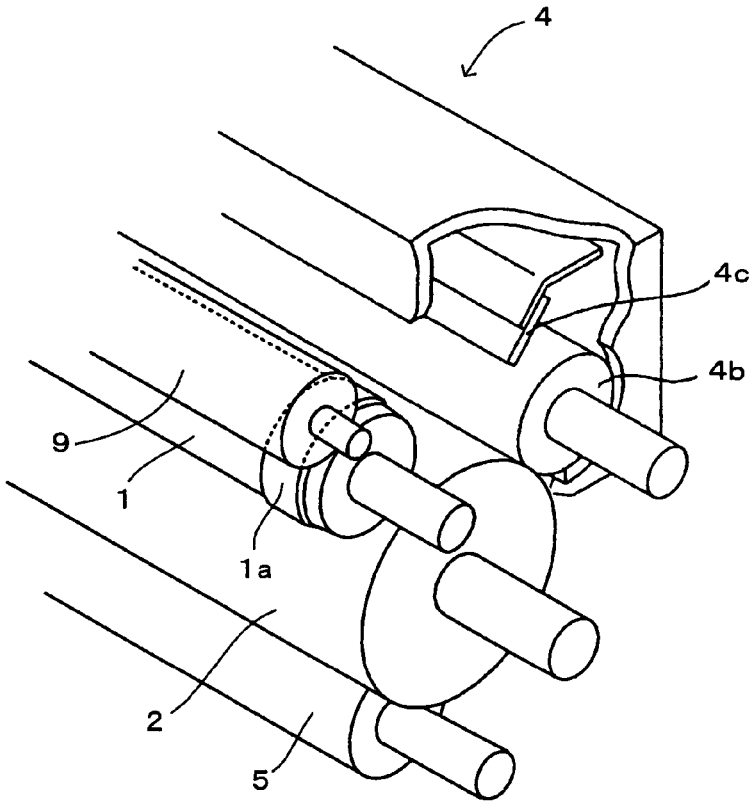
FIG. 2 is a perspective view of the embodiment.
Figure 3:
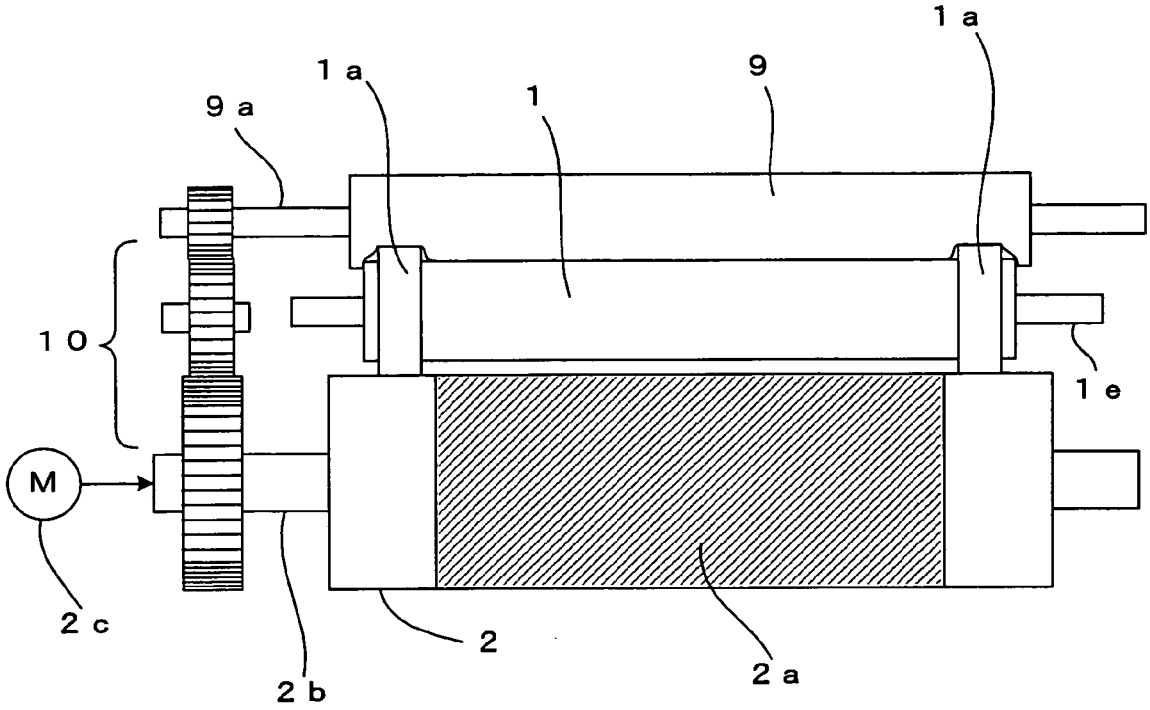
FIG. 3 is a front view which shows essential portions of the embodiment.

Preferred embodiments of the present invention will now be described with reference to the associated drawings. FIG. 1 is a side view which shows an embodiment of an image forming apparatus according to the present invention and FIG. 2 is a perspective view of the embodiment. FIG. 3 is a front view which shows essential portions of the embodiment, and FIG. 4 is a right side view of FIG. 3.

In this embodiment, disposed along the periphery of an image carrier 2 on which an electrostatic latent image is to be formed are a proximity charger roller 1 made of metal comprising abutting portions 1*a*, which are located on the outer side relative to the both edges of an effective charging area 2*a* (hatched area in FIG. 3) which is at the center, and uniformly charging a surface of the image carrier 2 from a circumferential surface which is in proximity to the surface of the image carrier 2 through steps of the abutting portions 1*a* (i.e., over a constant proximity distance), an exposure apparatus 3 which writes an electrostatic latent image on thus uniformly charged surface of the image carrier 2, a developer apparatus 4 whose developing chamber 4*a* houses a developer roller 4*b* and a toner regulating blade 4*c* and which develops the electrostatic latent image formed on the surface of the image carrier 2 using toner, a transfer apparatus 5 which transfers a toner image on the image carrier 2 thus developed by the developer apparatus 4 onto a transfer member 8 such as a paper, a discharger apparatus 6 which discharges the image carrier 2 and the toner which remains on the image carrier 2 after the transfer, an image carrier cleaning portion 7 which removes the toner which remains on the image carrier 2 after the transfer, and the like. On the opposite side of the image carrier 2 relative to the proximity charger roller 1, there is a cleaning roller 9.

The proximity charger roller 1 is disposed in proximity to the surface of the image carrier 2 and uniformly charges the effective charging area 2*a* of the image carrier 2. The abutting portions 1*a* abut on the image carrier 2 at its both edges which are on the outer side of the effective charging area 2*a*, whereby the proximity distance (gap) between the circumferential surface of the proximity charger roller 1 and the image carrier 2 is kept constant. The cleaning roller 9 is longer than the spacing between the abutting portions 1*a* which are at the both edges, abuts on the abutting portions 1*a* which are at the both edges and presses the same with predetermined pressing force in the direction of the image carrier 2. The surface of the cleaning roller 9 is made of a soft material (for instance urethane sponge in this embodiment), and the cleaning roller 9 cleans a surface area of the proximity charger roller 1, the surface area between the abutting portions 1*a* which are at the both edges. A gear train 10 links a rotation shaft 2*b* of the image carrier 2 to a rotation shaft 9*a* of the cleaning roller 9 so that the gear train 10 transmit the rotational drive force of a driving motor 2*c* which drives the image carrier 2 into rotations to the cleaning roller 9 and the cleaning roller 9 rotates in the same direction as the image carrier 2. Meanwhile, due to frictional force via the abutting portions 1*a*, the proximity charger roller 1 rotates driven following the image carrier 2.

Figure 4:
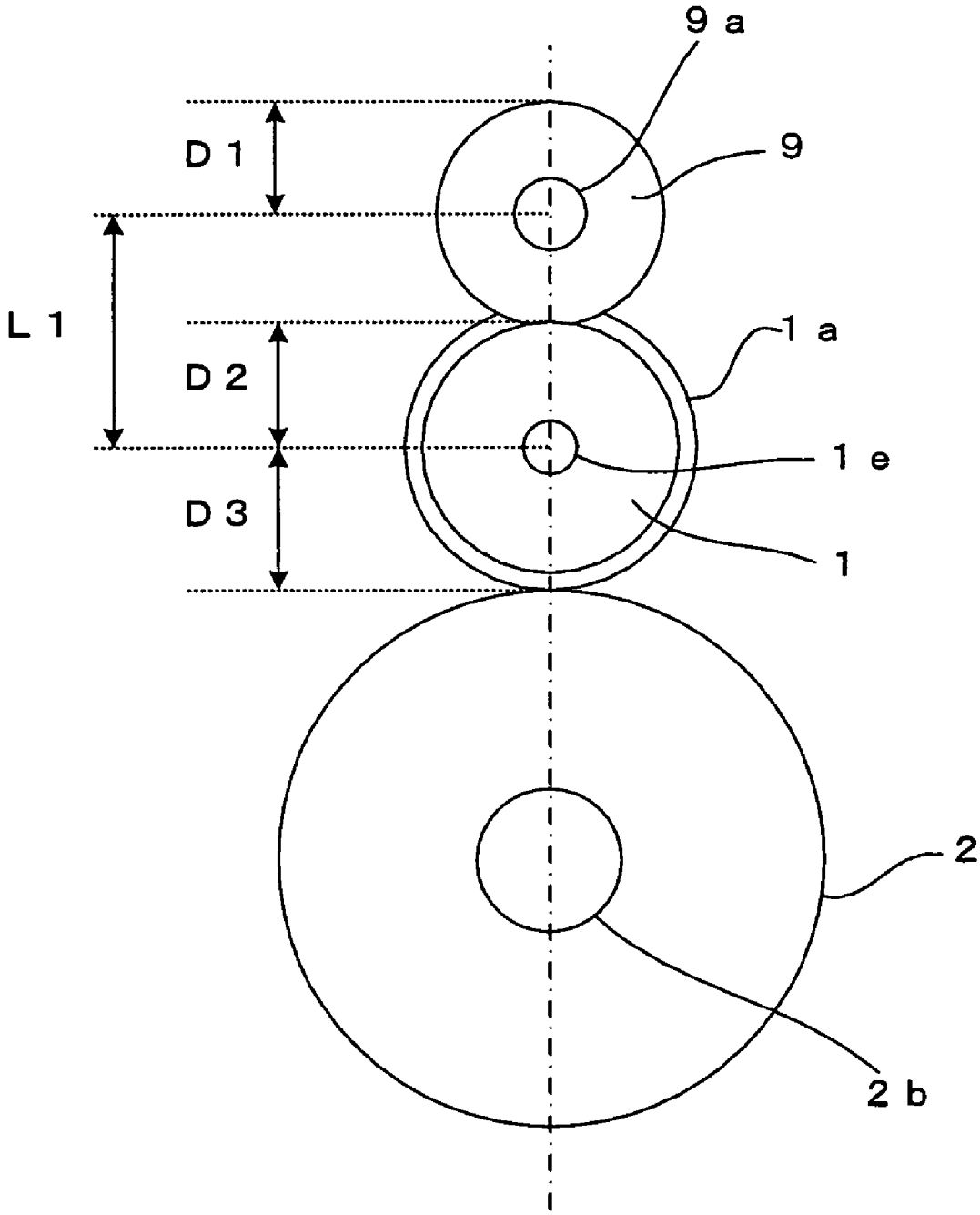
FIG. 4 is a right side view of FIG. 3.

As shown in FIG. 4, in this embodiment, the center of the axis of the rotation shaft 2*b* of the image carrier 2 and the center of the axis of the rotation shaft 1*e* of the proximity charger roller 1 are located in-line. When the distance between the center of the axis of the rotation shaft 1*e* of the proximity charger roller 1 and the center of the axis of the rotation shaft 9*a* of the cleaning roller 9 is defined as L1, the radius of the cleaning roller 9 is defined as D1 and the radius of the proximity charger roller 1 is defined as D2, the following relationship is satisfied:

$$L1<D1+D2$$

This structure ensures that the cleaning roller 9 abuts on an area of the proximity charger roller 1 which is between the pair of abutting portions 1*a* and that the cleaning roller 9 securely cleans the surface area of the proximity charger roller 1 which is between the abutting portions 1*a*.

Meanwhile, the pressing force of the cleaning roller 9 is applied to a certain extent upon the surface area of the proximity charger roller 1 which is between the abutting portions 1*a*, because the cleaning roller 9 abuts on the surface area of the proximity charger roller 1 which is between the abutting portions 1*a*. However, since the inequality below is satisfied where the radius of the abutting portions 1*a* is defined as D3, a dominant part of the pressing force of the cleaning roller 9 is applied upon the abutting portions 1*a*.

$$D2<D3$$

In this manner, according to this embodiment, as the cleaning roller 9 presses the abutting portions 1*a* which abut on the image carrier 2, the proximity charger roller 1, subjected to no bending moment, will never bend, so that the proximity distance (gap) is kept constant along the axial direction, whereby a favorable charging characteristic is obtained. Further, since the cleaning roller 9 cleans the proximity charger roller 1 at the same time, the favorable charging characteristic is attained stably. In other words, according to this embodiment, since the cleaning roller 9 has both of the pressing function and the cleaning function, there is an advantage that it is possible to prevent the number of components from increasing.

Figure 5:
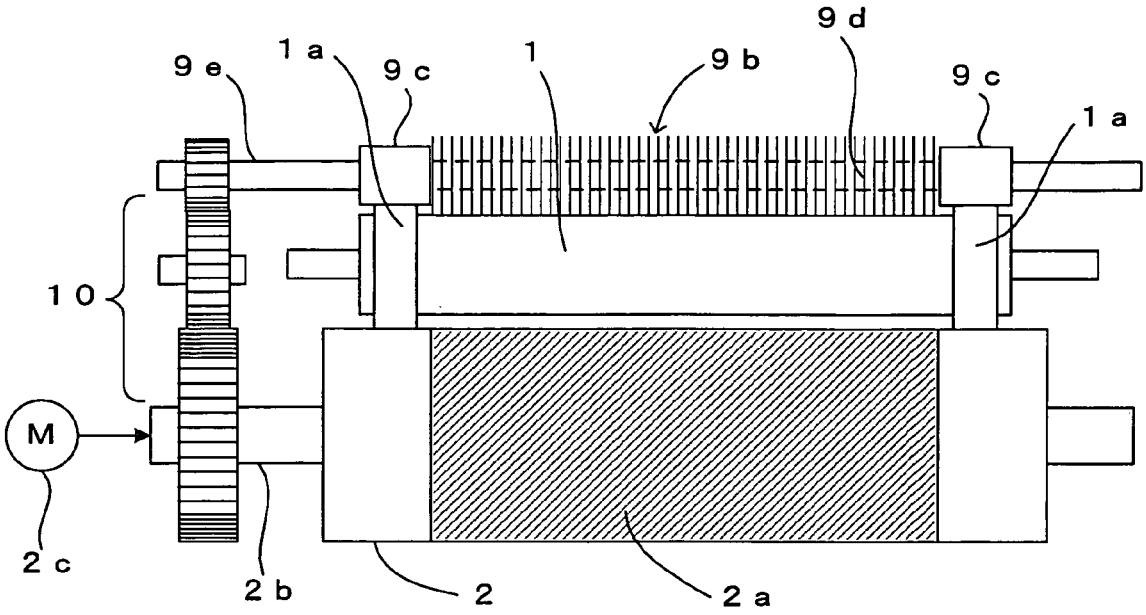
FIG. 5 is a front view illustrating an embodiment which uses a fur brush.
Figure 6:
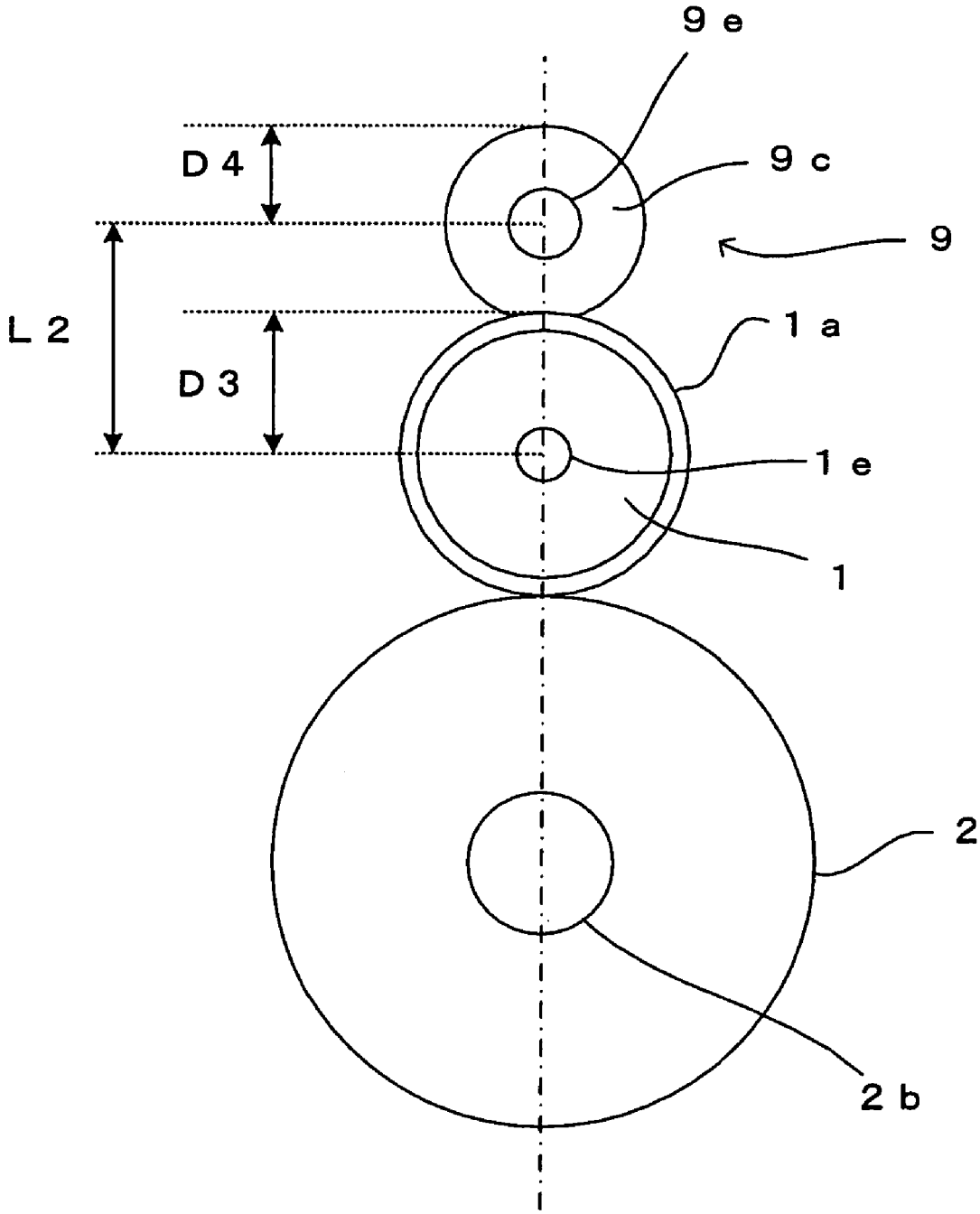
FIG. 6 is a right side view of FIG. 5.

The present invention is not limited to the embodiment described above but may be modified in various manners in addition to the embodiment above, to the extent not deviating from the object of the invention. For instance, in the embodiment described above, although urethane sponge is used as the soft material of the cleaning roller 9, this is not limiting and other soft materials may be used. Further, as the cleaning roller 9, for example, a cleaning pad, a fur brush or the like may be used. FIG. 5 is a front view illustrating an embodiment which uses a fur brush and FIG. 6 is a right side view of FIG. 5. In FIGS. 5 and 6, the same reference symbols are used as for those sections which are the same as in the embodiment above.

In the embodiment shown in FIGS. 5 and 6, a cleaning roller 9*b* comprises projections 9*c* which are disposed at positions corresponding to the abutting portions 1*a* of both edges, are made of an elastic material such as rubber, are shaped like rollers, and are formed projecting so as to abut on the abutting portions 1*a*, and a fur brush 9*d* which is formed between the two projections 9*b*. The projections 9*c* press the proximity charger roller 1 at the abutting portions 1*a* in the direction of the image carrier 2, and the fur brush 9*d* abuts on the surface area between the abutting portions 1*a* of the proximity charger roller 1 and cleans this area.

In this embodiment as well, as shown in FIG. 6, the center of the axis of the rotation shaft 2*b* of the image carrier 2, the center of the axis of the rotation shaft 1*e* of the proximity charger roller 1, and the center of the axis of the rotation shaft 9*e* of the cleaning roller 9*b* are located in-line. When the distance between the center of the axis of the rotation shaft 1*e* of the proximity charger roller 1 and the center of the axis of the rotation shaft 9*e* of the cleaning roller 9*b* is defined as L2 and the radius of the projections 9*c* of the cleaning roller 9*b* is defined as D4, the following relationship is satisfied:

$$L2<D3+D4$$

This structure ensures that the projections 9*c* of the cleaning roller 9 abut on and press the abutting portions 1*a* of the proximity charger roller 1 without fail.

Meanwhile, as the size of the fur brush 9*d* is sufficient to abut on the circumferential surface of the proximity charger roller 1 so that the fur brush 9*d* cleans the area between the abutting portions 1*a* of the proximity charger roller 1. In this manner, the embodiment shown in FIGS. 5 and 6 also achieves similar effects to those according to the earlier embodiment.

Figure 7:
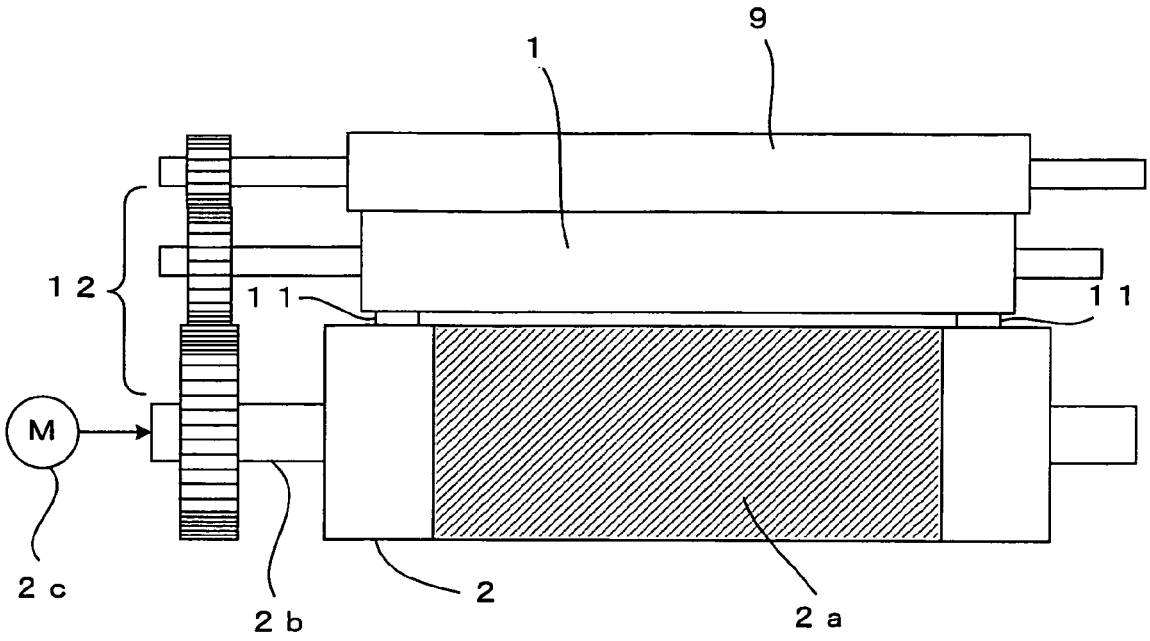
FIG. 7 is a front view illustrating other embodiment of the abutting portions.

Further, while the stepped sections formed on the circumferential surface of the proximity charger roller 1 serve as the abutting portions 1*a* in the embodiments above, the present invention is not limited to this. FIG. 7 is a front view illustrating other embodiment of the abutting portions. In FIG. 7, the same portions as those according to the embodiments above are denoted at the same reference symbols.

In the embodiment shown in FIG. 7, sheet-like members 11 are disposed which abut on the image carrier 2 at the both edges which are on the outer side of the effective charging area 2*a* of the image carrier 2. Conductive and elastic rubber or the like is used as the sheet-like members 11. When the cleaning roller 9 presses the proximity charger roller 1, whose outer diameter is constant, in the direction of the image carrier 2, the pressing force falls upon the positions where the sheet-like members 11 are disposed. The embodiment shown in FIG. 7 also achieves similar effects to those according to the embodiments above. In the embodiment shown in FIG. 7, a gear train 12, for example, may be used for transmission of the rotational drive force of the driving motor 2*c* to the proximity charger roller 1 and the cleaning roller 9.

Figure 8:
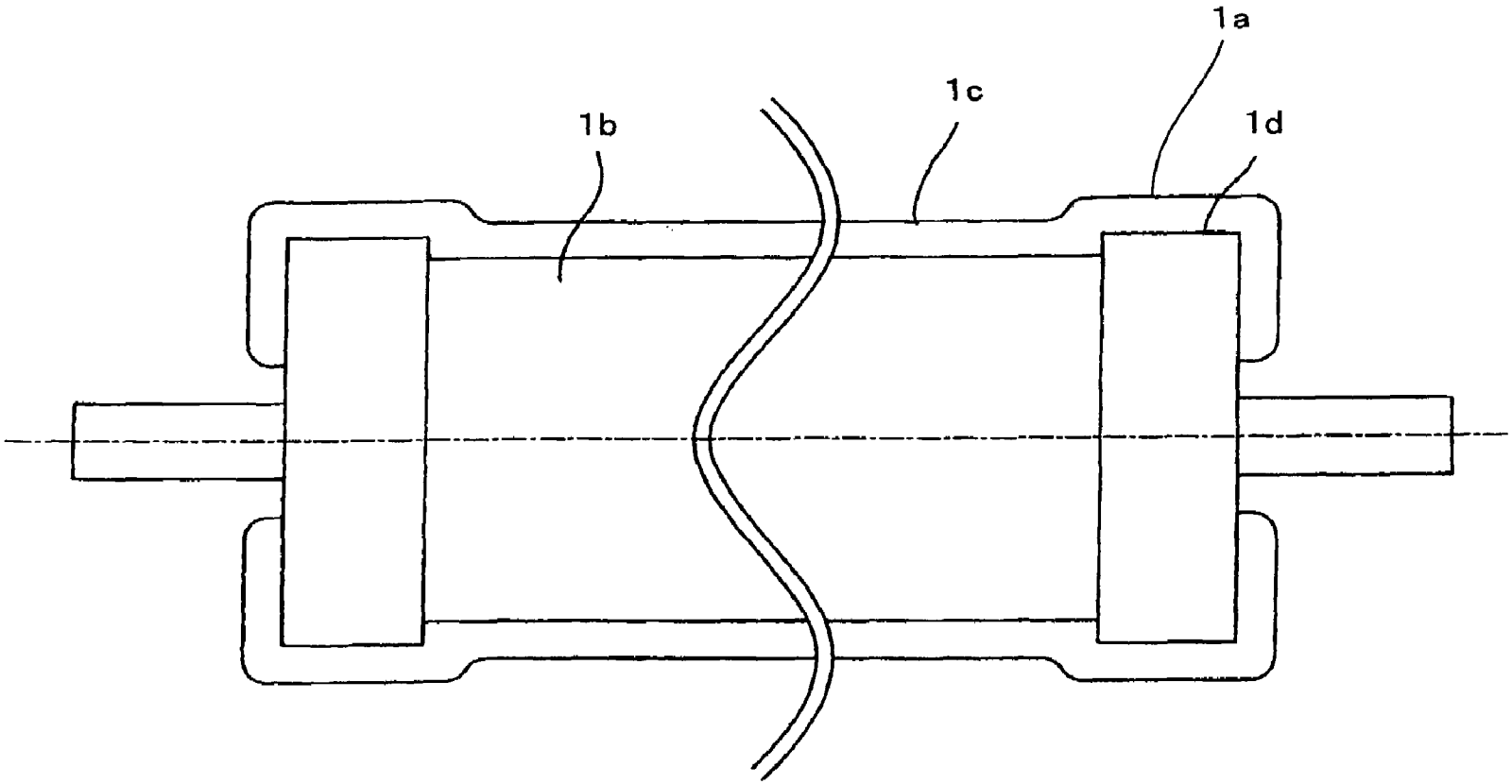
FIG. 8 is a cross sectional view illustrating other embodiment of the proximity charger roller.

The structure of the proximity charger roller 1 is not limited to that described in the embodiments above. FIG. 8 is a cross sectional view illustrating other embodiment of the proximity charger roller 1, in which denoted at 1*b* is a roller base, denoted at 1*c* is a conductive member and denoted at 1*d* are stepped sections. The proximity charger roller 1 is comprised of the base 1*b* and the conductive member 1*c* which covers the base 1*b* as shown in FIG. 8 for example. The conductive member 1*c* covers the base 1*b* and forms a surface layer. The abutting portions 1*a* abut on the image carrier 2, whereby a charging section in the center is disposed in proximity to the effective charging area of the image carrier 2 with a constant gap in between. Using a core of a SUS shaft for instance, the base 1*b* is formed as a roller shaft comprising stepped sections 1*d*, which are formed at both edges of the central region which serves as a charging section, namely, at edge portions which correspond to the abutting portions 1*a*, and whose diameter is larger than the diameter of the charging section. The stepped sections 1*d* are formed by turning and polishing the base 1*b* such that the height of the gap (step) is ensured. The conductive member 1*c* may be conductive rubber or conductive resin shaped like a tube, for instance a conductive, elastic and heat-shrinkable tube such as conductive Super Tere (registered trade mark) Tube (manufactured by TEIJIN CHEMICALS LTD.) or the like. The process is performed that the conductive member 1*c* is made to cover the base 1*b*, heated and shrunk. Considering a charging bias, the resistance of the conductive member 1*c* and the like, the height of the gap (step) formed by the stepped sections 1*d* is approximately from 20 μm to 100 μm for instance. The conductive member 1*c* is a conductive and elastic tube which is thicker than the height of the gap (step), and forms the surface layer of the proximity charger roller 1.

It is possible to manufacture the roller base 1*b* with stepped sections as that according to this embodiment by turning on a lathe. Since the proximity charger roller 1 is structured by covering the roller base 1*b* with the conductive member 1*c* which is a conductive, elastic and heat-shrinkable tube, it is possible to manufacture the proximity charger roller 1 in which the gap is more accurate than that formed with a gap tape in a conventional proximity charger roller. In addition, since the proximity charger roller 1 is obtained by the process that, after manufacturing the roller base 1*b* with stepped sections by turning on a lathe, the roller base 1*b* is covered with the conductive member 1*c* which is a heat-shrinkable tube and heated, the proximity charger roller 1 is manufactured easily without secondary processing such as surface polishing for the obtained proximity charger roller 1, and a manufacturing cost for the proximity charger roller 1 is reduced.

In the proximity charger roller 1 according to this embodiment, a surface layer is formed using a conductive and elastic tube, as the conductive member 1*c*, which is thicker than the height of the gap (step) of the roller base 1*b* with the stepped sections. Therefore, the gap portions (abutting portions) whose surface layer is formed with an elastic layer, being pressed, is nipped with pressure against the image carrier 2. Further, since the nipped surface layer shrinks by being pressed, the proximity distance can be made shorter than the height of the steps. In addition, since the same conductive and elastic tube equally covers the charging section which is the central region and the both edge portions, the tube around the both edge portions having the larger outer diameter become thinner on the roller after the shrinkage, whereas the tube around the charging section becomes thicker. In this manner, after the proximity charger roller is completed, the distance between the charging section of the proximity charger roller and the image carrier can be made closer than the height of the steps.

In the roller base 1*b* with stepped sections of the proximity charger roller 1, when the steps are produced by falling approximately vertically to the axial direction, stress is concentrated at the falling edge portions and the strength of these portions becomes weak. Therefore, after long time of printing, cracks are generated in the falling edge portions of the stepped sections, which leads to leakage between the roller base 1*b* with stepped sections of the proximity charger roller 1 upon which the charging bias is applied and the image carrier 2. Noting this, it is preferable to use the conductive member 1*c* thicker than the height of the gap (step). Furthermore, it is possible to prevent cracks when the proximity charger roller 1 is shaped that the diameter is increasingly smaller continuously from the stepped sections 1*d* of the base 1*b* which correspond to the abutting portions 1*a* to the charging section in the central region, that is, in a shape of slope for example. Of course, it goes without saying that it is possible to similarly prevent cracks when the stepped sections 1*d* falls not at the right angles but at predetermined R (diameter) or tilt angle or at a curved line, with at least the edge portions alone chamfered or the like.

Further, if the conductive member 1*c* covering the roller base 1*b* with stepped sections moves slightly in the axial direction after long time of printing, bulges up at the surface layer as a result of its movement and takes concave and convex shapes, the gap could change. For elimination of such movement, it is desirable that the surface of the base 1*b* has surface roughness Rz to a certain extent. Particularly when the conductive member 1*c* moves axially in the charging section of the roller base 1*b* with stepped sections and can not move easily in the stepped sections 1*d*, the conductive member 1*c* bulges up in the stepped sections 1*d* and the gap distance changes. To solve this problem, it is desirable that the surface roughness Rz of the stepped sections 1*d* of the roller base 1*b* is smaller than the surface roughness Rz of the charging section so that the conductive member 1*c* moves accordingly in the stepped sections 1*d* when the conductive member 1*c* moves axially in the charging section.

In other words, in the step between the region of the charging section and the both edge portions of the stepped sections of the roller base 1*b*, the diameter becomes smaller toward the central portion and the surface roughness of the surface of the charging section is greater than the surface roughness of the surface of the both edge portions as in the embodiment described above, whereby the tube which is the surface layer of the roller does not easily fall off and problems such as cracks and movement does not occur even after long time of image formation. This is because the great surface roughness in the charging section makes the shaft which is the base act as an anchor for the tube. Further, this is because even slight displacement of the tube if any will not result in concentration of displacement-induced force on the steps, since the diameter is progressively smaller and the surface roughness is small in the edge portions with steps.

Although the foregoing has described that the stepped sections 1*d* at the both edges of the roller base 1*b* are formed by turning on a lathe and polishing such that the height of the gap (step) is ensured, cylindrical members corresponding to the stepped sections 1*d* may be fit with the outer circumferential surface of the roller base at the both edges of the roller base, or alternatively, a shaft may penetrate and fit into cylindrical members.

Although the invention has been described with reference to specific embodiments, this description is not meant to be construed in a limiting sense. Various modifications of the disclosed embodiment, as well as other embodiments of the present invention; will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an image carrier;

a charger apparatus which charges an effective charging area of said image carrier using a proximity charger roller which is conductive and is disposed in proximity to a surface of said image carrier;

an exposure apparatus which forms a latent image in said effective charging area;

a developer apparatus which develops said latent image with a developer; and a driver which drives said image carrier into rotations, wherein said charger apparatus comprises:

a pair of abutting portions which abut on said image carrier at both edges which are located on outer side of said effective charging area, thereby maintaining a proximity distance from said proximity charger roller to said image carrier constant; and a cleaning roller which has an elongated shape longer than a spacing between said pair of abutting portions, has a pair of edge portions and a central portion in between, and is pressed against said proximity charger roller on an opposite side of said image carrier relative to said proximity charger roller in a condition that both of said pair of edge portions are located respectively facing said pair of abutting portions, thereby making said proximity charger roller abut on said image carrier with said pair of abutting portions between and cleaning a surface area of said proximity charger roller which is between said pair of abutting portions with said central portion, a gear train is provided which links a rotation shaft of said image carrier to a rotation shaft of said cleaning roller without linking to a rotation shaft of said proximity charger roller so that said gear train transmits a rotational drive force of said driver to said cleaning roller, which accordingly rotates in the same direction as said image carrier, a center of an axis of the rotation shaft of said image carrier, a center of an axis of the rotation shaft of said proximity charger roller, and a center of an axis of the rotation shaft of said cleaning roller are located in-line, said pair of abutting portions are disposed on an outer circumferential surface of said proximity charger roller so as to project therefrom, and said proximity charger roller rotates driven following rotation of said image carrier due to frictional force via said pair of abutting portions, the frictional force being enhanced by a pressing force from said cleaning roller.

2. The image forming apparatus of claim 1, wherein an outer circumferential surface of said cleaning roller is made of a soft material, and a distance between a center of a rotation axis of said cleaning roller and that of said proximity charger roller is set to be smaller than a sum of a radius of said cleaning roller and that of said proximity charger roller.

3. The image forming apparatus of claim 1, wherein said cleaning roller has a pair of projecting portions, which are disposed on an outer circumferential surface of said cleaning roller, and a cleaning portion, which abuts on and cleans said outer circumferential surface of said proximity charger roller, said pair of projecting portions projecting from said cleaning portion and abutting on said pair of abutting portions, and a distance between a center of a rotation axis of said cleaning roller and that of said proximity charger roller is set to be smaller than a sum of a radius of said projecting portions and that of said abutting portions.

4. The image forming apparatus of claim 1, wherein said proximity charger roller is made of metal.

5. The image forming apparatus of claim 1, wherein said proximity charger roller comprises a roller base on which stepped sections, each of which has a step, are formed projecting from said roller base at its both edges, and all circumferences of which are covered with a conductive member, and said stepped sections, as said abutting portions, abut on said image carrier through said conductive member which covers said stepped sections.

* * * * *